US010272547B1

(12) United States Patent
Lai

(10) Patent No.: US 10,272,547 B1
(45) Date of Patent: Apr. 30, 2019

(54) SOCKET HOLDER

(71) Applicant: Jin-Lan Lai, Taichung (TW)

(72) Inventor: Jin-Lan Lai, Taichung (TW)

( * ) Notice: Subject to any disclaimer, the term of this patent is extended or adjusted under 35 U.S.C. 154(b) by 0 days.

(21) Appl. No.: 15/958,455

(22) Filed: Apr. 20, 2018

(51) Int. Cl.
*B25H 3/00* (2006.01)
*B25B 13/56* (2006.01)
*B25B 13/06* (2006.01)

(52) U.S. Cl.
CPC ..... *B25B 13/56* (2013.01); *B25B 13/06* (2013.01); *B25H 3/003* (2013.01)

(58) Field of Classification Search
CPC ..... B25H 13/003; B25H 13/04; B25H 13/00; B25B 13/56; B25B 13/06
USPC ..... 206/378, 376; 211/70.6
See application file for complete search history.

(56) References Cited

U.S. PATENT DOCUMENTS 6,431,373 B1 * 8/2002 Blick ..... B25H 3/003 206/378
7,658,284 B2 * 2/2010 Lin ..... B25H 3/003 206/378
9,186,790 B1 * 11/2015 Kao ..... B25H 3/06
9,522,467 B1 * 12/2016 Kao ..... A47F 7/0028
9,527,206 B1 * 12/2016 Hsieh ..... B25H 3/003
9,538,862 B2 * 1/2017 Kao ..... A47F 5/08
9,656,385 B1 * 5/2017 Kao ..... B25H 3/04
9,757,853 B2 * 9/2017 Su ..... B25H 3/04
9,914,207 B2 * 3/2018 Kao ..... B25H 3/04
9,956,681 B2 * 5/2018 Kao ..... B25H 3/06
2010/0170817 A1 * 7/2010 Wu ..... B25H 3/003 206/378

* cited by examiner

*Primary Examiner* — Steven A. Reynolds
(74) *Attorney, Agent, or Firm* — Muncy, Geissler, Olds & Lowe, P.C.

(57) ABSTRACT

A socket holder is provided, including a base, having at least one first slide locking portion, each first slide locking portion extending along a first direction; at least one support base, each support base having a second slide locking portion which is engageably connected with one of the at least one first slide locking portion along the first direction, the second slide locking portion overlapping one of the at least one first slide locking portion in a second direction perpendicular to the first direction, the second slide locking portion being undisengageable from one of the at least one first slide locking portion in the second direction, the at least one first slide locking portion and the at least one second slide locking portion being in a male-female connection relationship, each support base including at least one connection portion which is rotatable.

1 Claim, 6 Drawing Sheets

SOCKET HOLDER

BACKGROUND OF THE INVENTION

Field of the Invention

The present invention relates to a socket holder.

Description of the Prior Art

In general, sockets will be connected with a tool hanger to be displayed on the wall or board for viewing.

A conventional tool holder includes a hanger and a plurality of slidable bases. The hanger has a plurality of tracks, the plurality of slidable bases which are respectively disposed slidably on the plurality of tracks, each slidable bases is adapted for a socket to be assembled to. The tracks of the conventional tool holder are integrally formed with the hanger. Therefore, one hanger can only be assembled the plurality of slidably bases at one place. Thus, it is unable to speed up the production process through division of labor, so the conventional tool holder requires higher time cost. Besides, the socket has differences between the British unit and the metric system. The conventional tool holder is lack of system to classify the sockets so that it is hard to identify types of the socket. Moreover, a number of sliding rails increases the size of the tool hanger increases. Thus, the conventional tool holder is inconvenient for using and carrying.

The present invention is, therefore, arisen to obviate or at least mitigate the above mentioned disadvantages.

SUMMARY OF THE INVENTION

An object of the present invention is to provide a socket holder, which is easy to store, classify, and reduce manufacturing time.

To achieve the above and other objects, a socket holder is provided, including a base, having at least one first slide locking portion, each of the at least one first slide locking portion extending along a first direction; at least one support base, each of the at least one support base having a second slide locking portion, the second slide locking portion engageably connected with one of the at least one first slide locking portion along the first direction, the second slide locking portion overlapping one of the at least one first slide locking portion in a second direction perpendicular to the first direction, the second slide locking portion being undisengageable from one of the at least one first slide locking portion in the second direction, the at least one first slide locking portion and the at least one second slide locking portion being in a male-female connection relationship, each of the at least one support base including at least one connection portion which is rotatable, each of the at least one connection portion being adapted for assembling with a socket.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
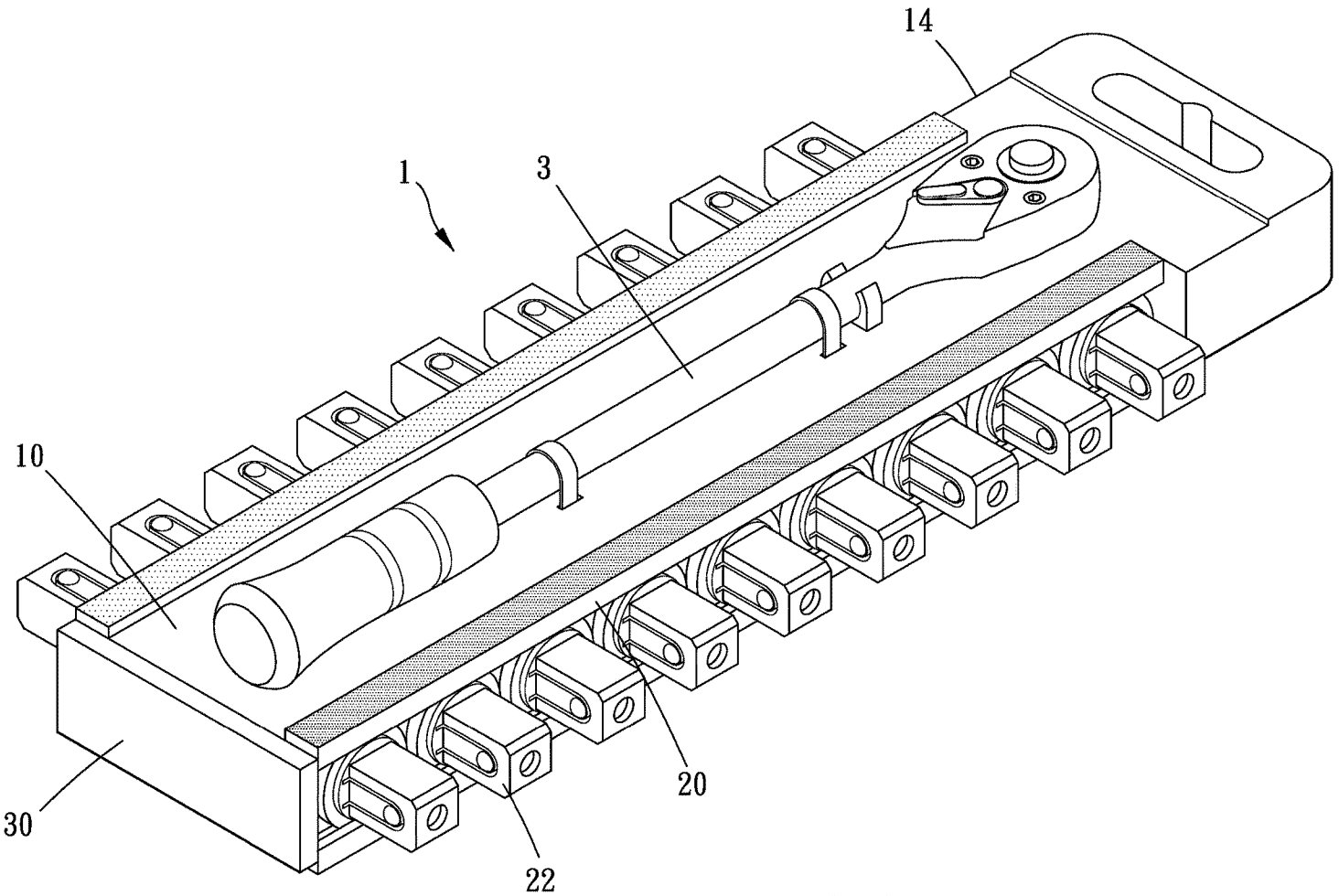
FIG. 1 is a perspective view of a socket holder according to a preferred embodiment of a present invention.
Figure 2:
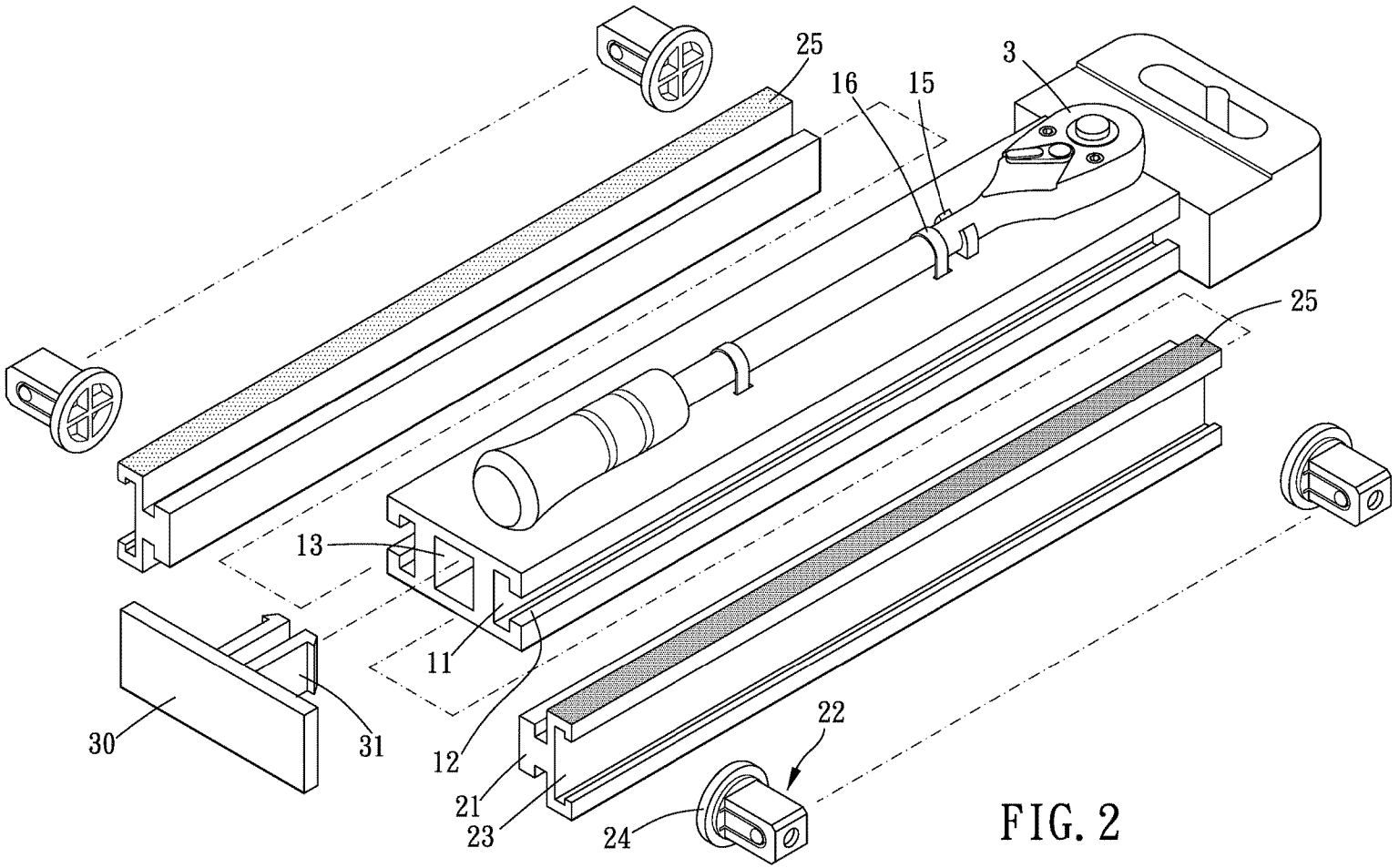
FIG. 2 is a breakdown view of the preferred embodiment of the present invention.
Figure 3:
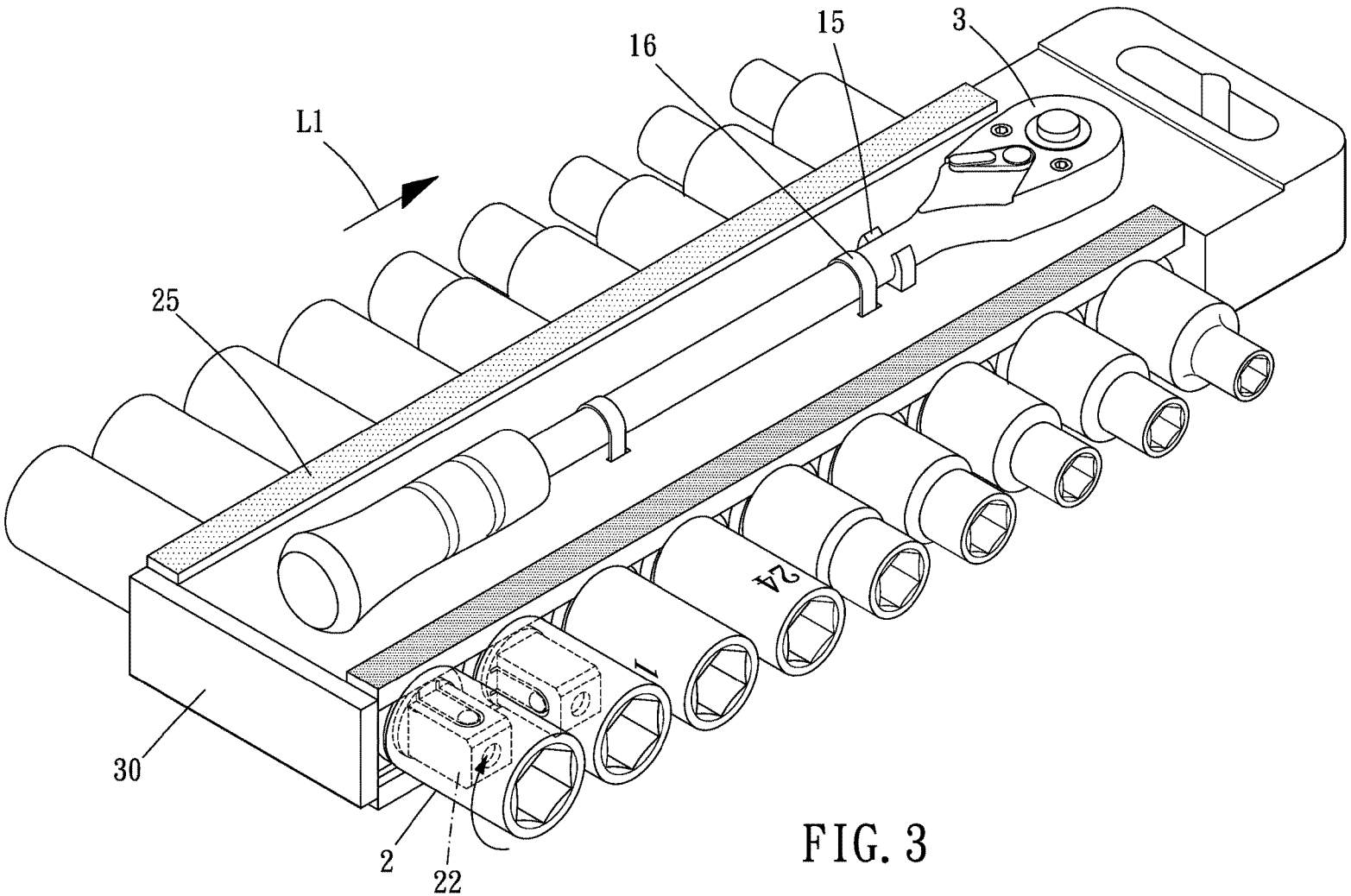
FIG. 3 is a drawing showing the preferred embodiment of the present invention in use.
Figure 4:
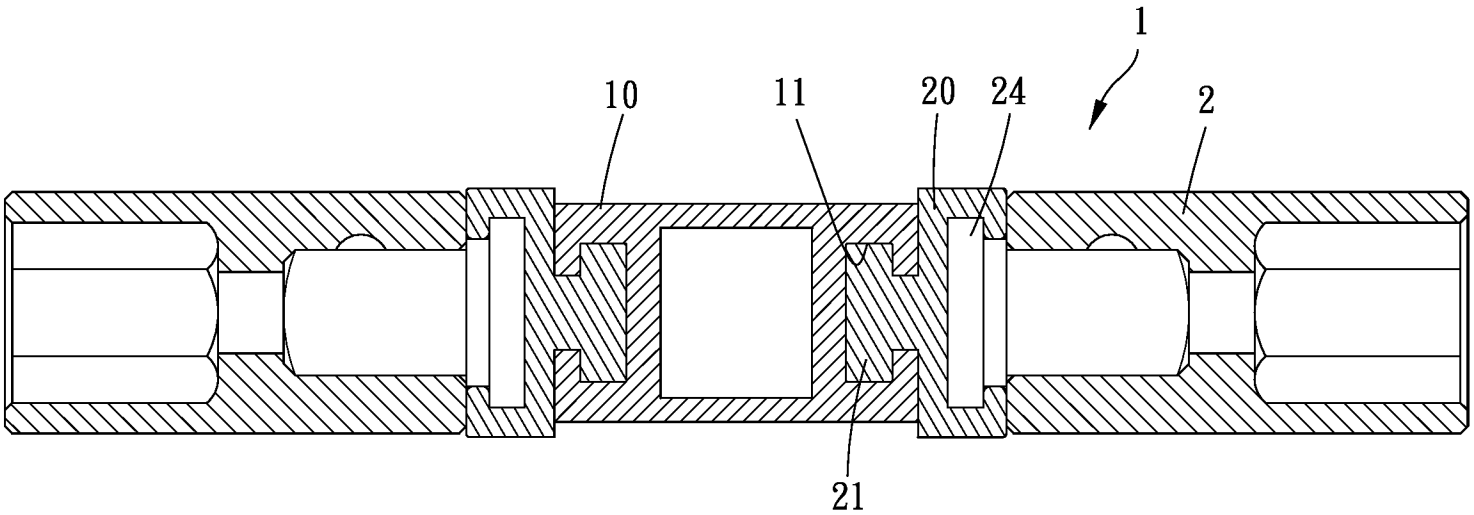
FIG. 4 is a cross-sectional view of the preferred embodiment of the present invention.

FIGS. 1 to 4 show a socket holder according to a preferred embodiment of the present invention. The socket holder 1 includes a base 10 and at least one support base 20.

The base 10 has at least one first slide locking portion, each of the at least one first slide locking portion extending along a first direction L1. Each of the at least one support base 20 has a second slide locking portion, the second slide locking portion is engageably connected with one of the at least one first slide locking portion along the first direction L1, the second slide locking portion overlaps one of the at least one first slide locking portion in a second direction perpendicular to the first direction L1, the second slide locking portion is undisengageable from one of the at least one first slide locking portion in the second direction. The at least one first slide locking portion and at least one the second slide locking portion are in a mal-female connection relationship. Each of the at least one support base 20 includes at least one connection portion 22 which is rotatable. Each of the at least one connection portion 22 is adapted for assembling with a socket 2. Thereby, the present invention is easy to use, store, classify sockets and reduce manufacturing time. Besides, each of the at least one support base 20 is connected with the base 10 stably without easily disengaging from each other. Moreover, it is easy for viewing a mark which is disposed on the socket 2.

Specifically, one of the at least one first slide locking portion and the at least one second slide locking portion is a sliding groove 11, the other of the at least one first slide locking portion and the at least one second slide locking portion is a sliding rail 21 which is engageably disposed in the sliding groove 11. As viewed in the first direction L1, a shape of the sliding groove 11 is corresponding to a shape of the sliding rail 21. The sliding groove 11 has an opening 12 which opens toward the second direction. A span of the opening 12 is smaller than a width size of the sliding rail 21. In this embodiment, the sliding groove 11 is substantially a T-shaped groove, the sliding rail 21 is a T-shaped convex which is corresponding to the T-shaped groove. Thus, the base 10 and each of the at least one support base 20 can only engage to each other in the first direction L1, and lean against to each other in second direction for preventing the base 10 and each of the at least one support base 20 from easily detaching from each other. Furthermore, each of the at least one support base 20 is free to assemble and disassemble to the base 10, so as to reduce the size for being stored. In other embodiment, the sliding rail can be a cylinder, or a partial cylinder for being disposed pivotably within the sliding groove of the base. Moreover, the sliding groove is corresponding to the sliding rail. Thus, each support base can be pivoted to the base for adjusting an angle. Besides, the sliding rail can also be a polygon column and a shape of the sliding groove is corresponding to the sliding rail. In this embodiment, the at least one first slide locking portion is a sliding groove 11, and the at least one second slide locking portion is a sliding rail 21. Besides, the first slide locking portion and the second slide locking portion can respectively be made of elastic deformation material, so as to elastically abut against each other to maintain position.

In this embodiment, a number of the at least one first slide locking portion is two, and two of the first slide locking portions are disposed on opposite two sides of the base 10, a number of the at least one support base 20 is two, and two of the support bases 20 are respectively disposed on one of the two locking portions, so as to store, carry and take out the socket 2 easily. In other embodiment, the number of the at least one support base can be more than two. The plurality of support bases can be disposed on any of adjacent two sides of the base so as to classify different types of sockets.

The socket holder 1 further includes an end plug 30. The end plug 30 is disposed detachably on the base 10. Each of the at least one first slide locking portion and the second slide locking portion are overlapped in the first direction L1. Thus, the end plug 30 can prevent each of the at least one support base 20 from detaching from the base 10 in the first direction L1. Specifically, the base 10 has at least one receiving 13 which opens toward the first direction L1. The end plug 30 has at least one insert portion 31 which is disposed detachably in the at least one receiving 13. In other embodiment, a number of the at least one receiving can be plural so that the end plug 30 can be firmly connected with the base 10 through inserting the insert portion 31 into the plurality of receivings.

In this embodiment, each of the at least one support base 20 has a rail groove 23, each of the at least one connection portion 22 has a disc portion 24 which is disposed slidably detachably within the rail groove 23. The disc portion 24 abuts radially against the rail groove 23 and is rotatable relatively to the rail groove 23. Therefore, each of the at least one connection portion 22 can be assembled to and detached from the rail groove 23 easily, and can be rotatable relatively to the rail groove 23, so as to view a mark which is disposed on the socket 2 easily.

Preferably, one side of the at least one support base 20 has a color label 25. The color label 25 exposes out of the base 10 when the at least one support base 20 is disposed engageably on the base 10. In this embodiment, the color label 25 exposes to a direction which is transverse to the first direction L1 for viewing the color label 25 more directly. Furthermore, each of the at least one support base 20 can classify sockets through the color label 25, such as the British unit type and the metric system type. Preferably, the color labels 25 of the two support bases 20 are in the different colors, so as to identify the classification of sockets 2 immediately by the color label 25. Please refer to FIG. 2 the color labels 25 of the two support base 20 are shown in different sprinkles as different colors. In other embodiment, the base has at least one perspective portion such as a transparent portion, a hollow portion, and etc., so as to expose the color label 25 out of each of the at least one support base 20.

The base 10 has a tool connection portion 14 which is disposed between the two first slide locking portions. The tool connection portion 14 has at least one clamp member 15, the at least one clamp member 15 is adapted for clamping a tool 3, so as to assemble positionally the tool 3 to the tool connection portion 14. Thus, the base 10 is provide for storing variety of tools such as hand tools, parts, sockets and so on. In this embodiment, the tool connection portion 14 further includes a retaining ring 16 which is releasably disposed thereon, the retaining ring is adapted for clamping the tool 3 firmly, in case of being stolen.

Figure 5:
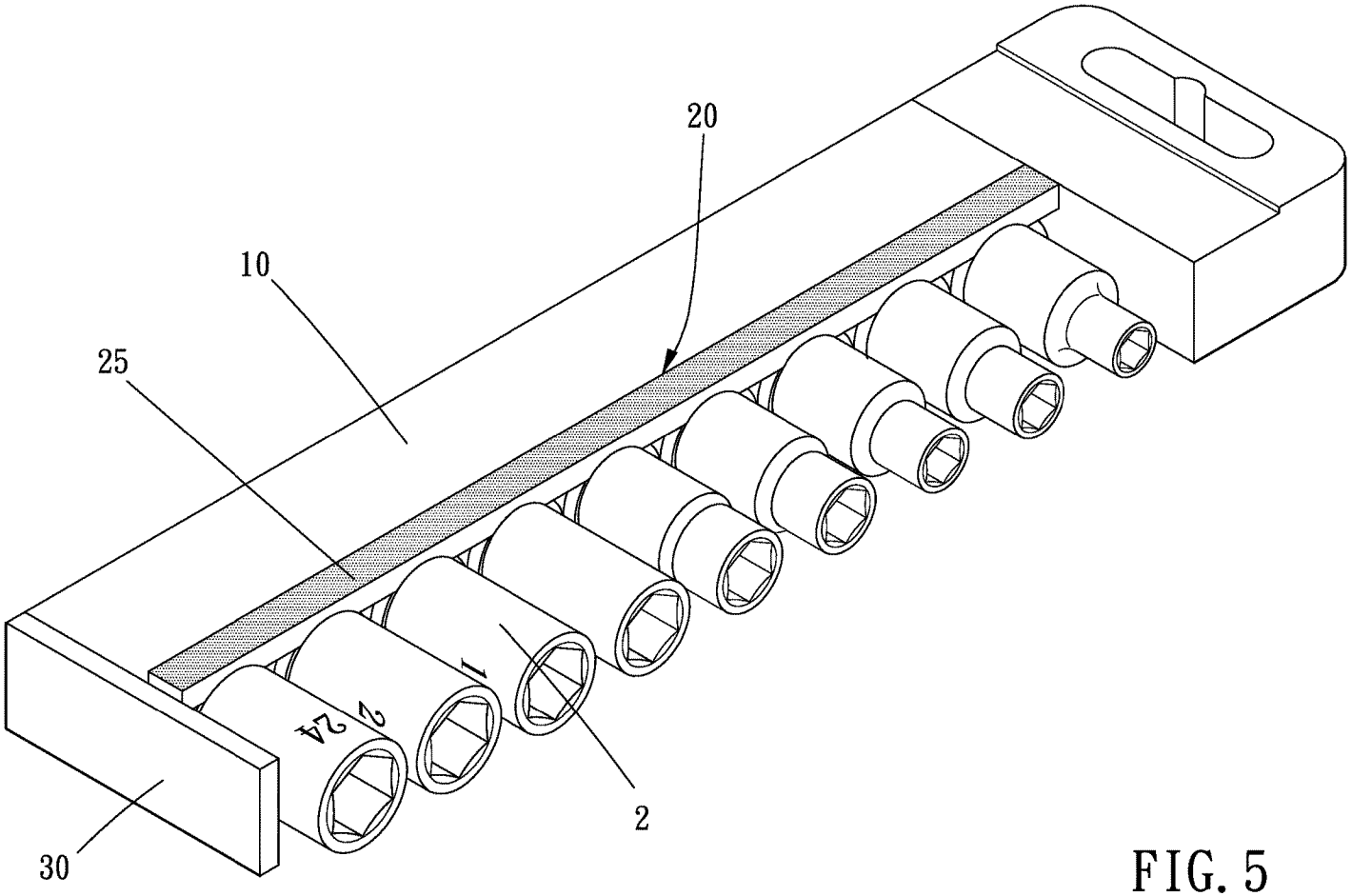
FIG. 5 is a perspective view of a socket holder according to another preferred embodiment of a present invention.
Figure 6:
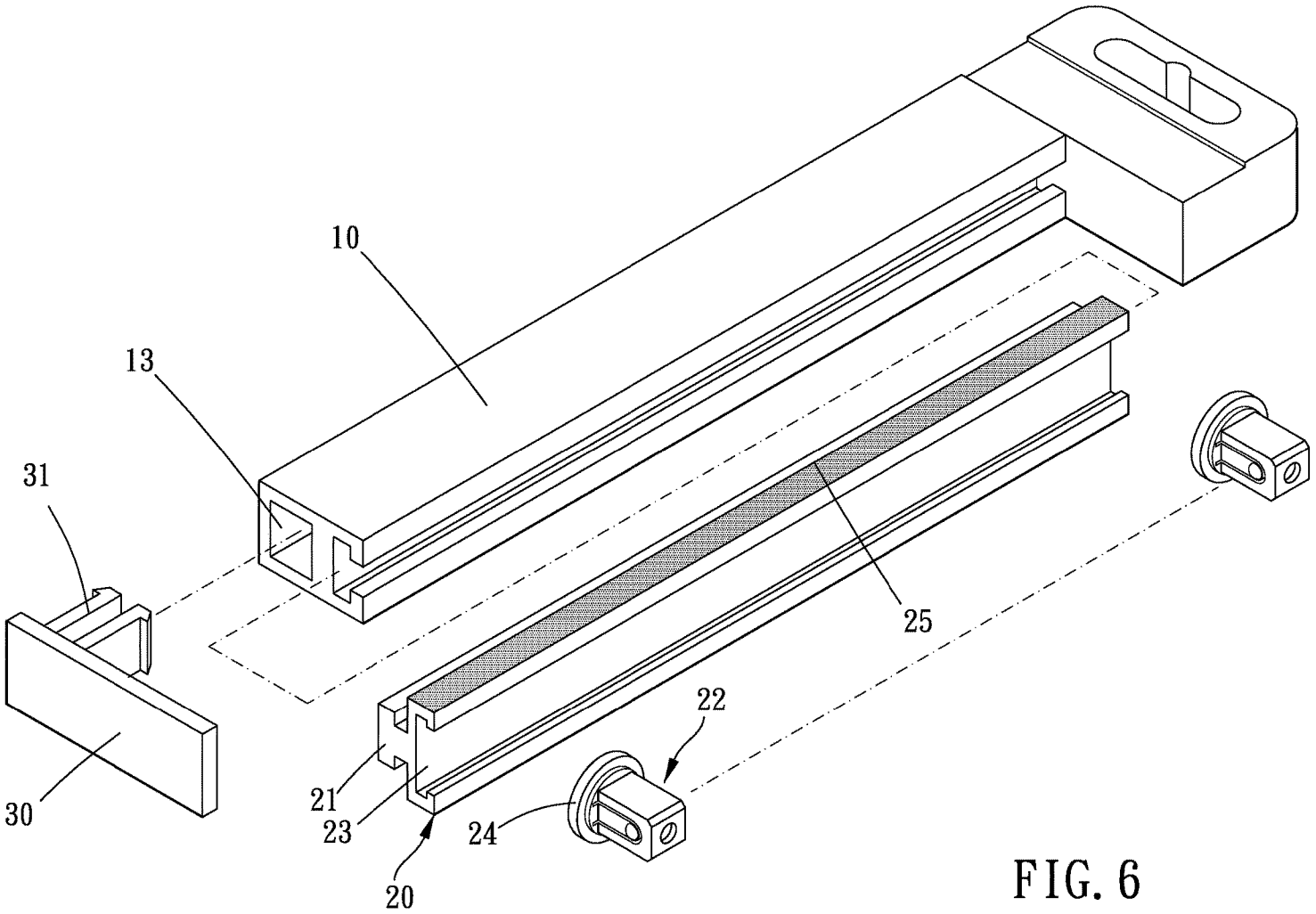
FIG. 6 is a breakdown view of FIG. 5.

Please refer to FIGS. 5 to 6 which are shown as the other preferred embodiment of the present invention. As compared with the first preferred embodiment, a number of the at least one support base 20 is one, the support base 20 is disposed on one side of the base 10. Preferably, an extending size of the end plug 30 is greater than the sliding groove 11 to block the disc portion 24 of the connection portion 22 and the socket 2 which is assembled to the connection portion 22.

Given the above, each of the at least one support base is disposed detachably on the base, so as to store and classify easily, and reduce manufacturing time. Besides, each of the at least one support base is not easy to detach from the base. Moreover, the connection portion is disposed rotatably on the support base for viewing the mark of the socket easily.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A socket holder, including:

a base, having at least one first slide locking portion, each of the at least one first slide locking portion extending along a first direction;

at least one support base, each of the at least one support base having a second slide locking portion, the second slide locking portion engageably connected with one of the at least one first slide locking portion along the first direction, the second slide locking portion overlapping one of the at least one first slide locking portion in a second direction perpendicular to the first direction, the second slide locking portion being undisengageable from one of the at least one first slide locking portion in the second direction, the at least one first slide locking portion and the at least one second slide locking portion being in a male-female connection relationship, each of the at least one support base including at least one connection portion which is rotatable, each of the at least one connection portion being adapted for assembling with a socket;

wherein one of the at least one first slide locking portion and the at least one second slide locking portion is a sliding groove, the other of the at least one first slide locking portion and the at least one second slide locking portion is a sliding rail which is engageably disposed in the sliding groove, as viewed in the first direction, a shape of the sliding groove is corresponding to a shape of the sliding rail, the sliding groove has an opening which opens toward the second direction, and a span of the opening is smaller than a width size of the sliding rail;

wherein the sliding groove is substantially a T-shaped groove, and the sliding rail is a T-shaped convex which is corresponding to the T-shaped groove;

wherein one side of the at least one support base has a color label; the color label is exposed from the base when the at least one support base is disposed engageably on the base; the color label is exposed in a direction which is transverse to the first direction; the socket holder further including an end plug, the end plug disposed detachably on the base, the end plug, each of the at least one first slide locking portion and the second slide locking portion being overlapped in the first direction; wherein the base has at least one receiving which opens toward the first direction, the end plug has at least one insert portion which is disposed detachably in the at least one receiving; each of the at least one support base has a rail groove, each of the at least one connection portion has a disc portion which is disposed slidably detachably within the rail groove, the disc portion abuts radially against the rail groove and is rotatable relative to the rail groove; a number of the at least one first slide locking portion is two, and the two first slide locking portions are disposed on opposite two sides of the base, a number of the at least one support base is two, and the two support bases are respectively disposed on one of the two of the first slide locking portions; the color labels of the two support bases are in the different colors; the base has a tool connection portion which is disposed between the two first slide locking portions, the tool connection portion has at least one clamp member, the at least one clamp member is adapted for clamping a tool; and the tool connection portion further includes a retaining ring which is releasably disposed thereon, the retaining ring is adapted for clamping the tool.

* * * * *